US009259783B2

(12) United States Patent
Ahrens et al.

(10) Patent No.: US 9,259,783 B2
(45) Date of Patent: Feb. 16, 2016

(54) NOZZLE FOR HORIZONTAL CONTINUOUS CASTER

(71) Applicants: Max Ahrens, Indio, CA (US); George Pepelanov, Fullerton, CA (US)

(72) Inventors: Max Ahrens, Indio, CA (US); George Pepelanov, Fullerton, CA (US)

( * ) Notice: Subject to any disclaimer, the term of this patent is extended or adjusted under 35 U.S.C. 154(b) by 469 days.

(21) Appl. No.: 13/628,937

(22) Filed: Sep. 27, 2012

(65) Prior Publication Data

US 2014/0084030 A1 Mar. 27, 2014

(51) Int. Cl.
*B22D 41/50* (2006.01)

(52) U.S. Cl.
CPC ..... *B22D 41/50* (2013.01)

(58) Field of Classification Search
CPC ..... B22D 41/50; B22D 41/52; B22D 41/56; B22D 11/045; B22D 11/047; B22D 11/0455
USPC ..... 222/591, 594, 566, 606, 607; 266/236; 164/440, 490, 337, 439, 437
See application file for complete search history.

(56) References Cited

U.S. PATENT DOCUMENTS

| | | | | | |
|---|---|---|---|---|---|
| 4,412,008 | A * | 10/1983 | Miyamoto et al. | ..... | 501/96.4 |
| 4,653,570 | A * | 3/1987 | Stonecliffe et al. | ..... | 164/440 |
| 4,682,718 | A * | 7/1987 | Watanabe et al. | ..... | 222/591 |
| 5,191,928 | A * | 3/1993 | Sato et al. | ..... | 164/466 |
| 2006/0124776 | A1 * | 6/2006 | Nomura et al. | ..... | 239/589 |

* cited by examiner

*Primary Examiner* — Scott Kastler
*Assistant Examiner* — Michael Aboagye
(74) *Attorney, Agent, or Firm* — Roy A. Ekstrand

(57) ABSTRACT

A horizontal continuous caster includes a tundish supporting a quantity of molten metal together with a cooled mold and conventional casting movement apparatus. The interface between the cooled mold and the tundish is provided by an improved tundish nozzle having a fabrication which locates the contact area between the nozzle and the cooled mold surfaces to the nozzle periphery thereby locating heat transfer between the mold and the molten metal within the tundish nozzle at the outer portion of the nozzle. The nozzle structure creates peripheral contact area and insulative air spaces between the nozzle and mold surfaces. The improved insulative properties of the nozzle construction in turn facilitates the use of higher strength, longer wear materials for the tundish nozzle.

11 Claims, 3 Drawing Sheets

Fig 1
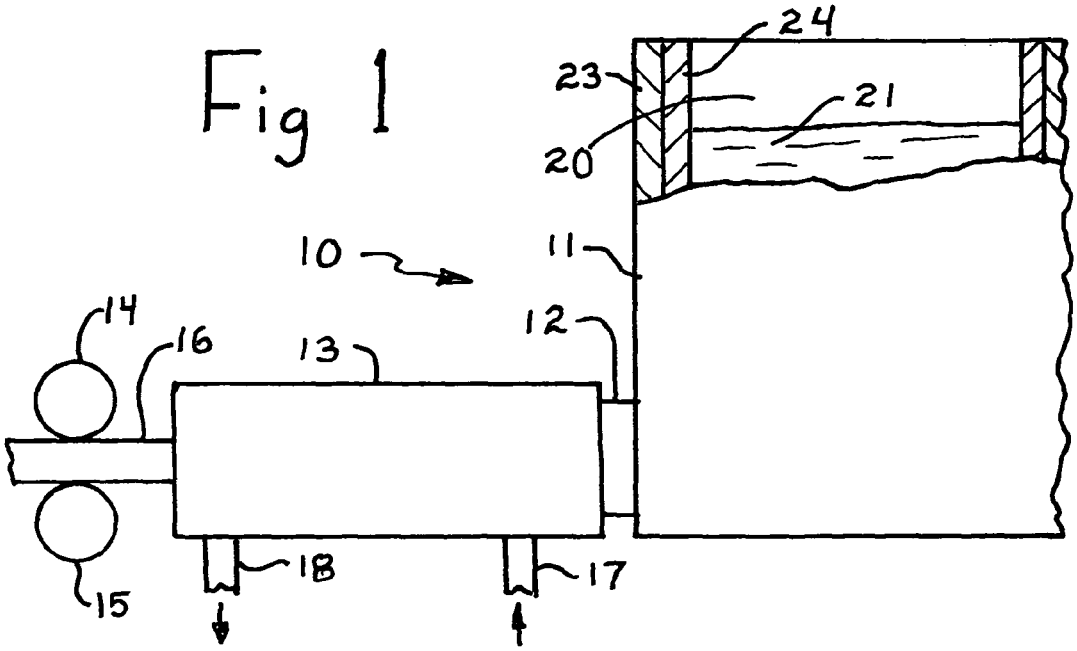
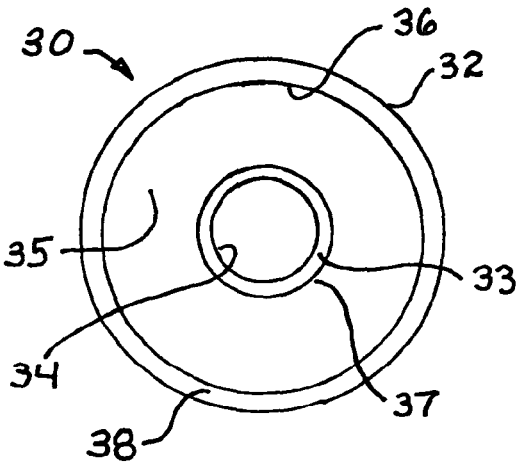
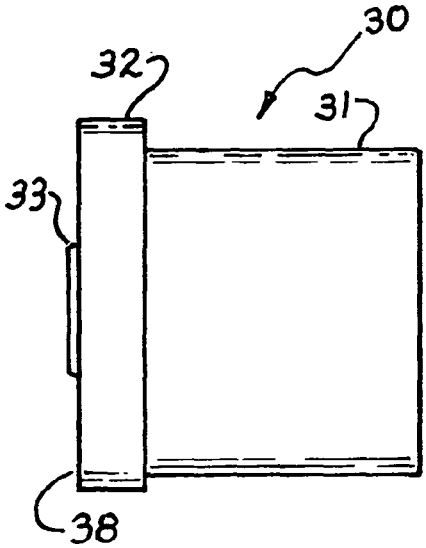
Fig 3
Fig 2

NOZZLE FOR HORIZONTAL CONTINUOUS CASTER

FIELD OF THE INVENTION

This invention relates generally to horizontal continuous casters and particularly to improved tundish nozzles used therein.

BACKGROUND OF THE INVENTION

The horizontal continuous casting process has provided substantial benefits in the metal fabricating arts and is particularly appreciated for its ability to produce extending length constant cross-section castings or billets which would be generally impractical if attempted using other more conventional casting systems. While the structures of horizontal continuous casting systems vary substantially, generally all include a large capacity insulated reservoir for molten metal referred to as a tundish. The most common tundish fabrication includes a container having an interior lining of refractory material chosen for its extreme resistance to the high temperatures associated with metal casting or a modified induction furnace. The tundish is further provided with an outlet orifice near the lower portion of the tundish and provision is made to couple a casting mold in communication with the tundish such that molten metal may be transferred from the tundish interior to the mold.

Mold structures vary somewhat but generally all comprise elongated metal structures defining an input orifice, an outlet orifice and a central passage therethrough. Molds are usually formed of a metal such as copper having a high heat transfer characteristic. The center mold passage is surrounded by a water cooled jacket which in turn is coupled to a supply of cooling water having sufficient flow to carry the heat from the mold passage during the casting process. The molten metal is introduced into the cooled mold via the input orifice and is solidified or frozen within the mold central passage to form the casting. In most instances, a dummy or started bar is inserted into the mold passage and coupled to a casting puller arrangement to initiate the casting process. As the process begins, the started bar is withdrawn from the mold through the mold passage and the metal within the tundish is permitted to flow into the mold passage. Within the mold passage, the casting forms in a welded attachment to the starter bar. The casting pullers thereafter extract the casting formed within the mold in accordance with a predetermined motion profile in which the casting emerges from the mold and is continuously formed or cast as metal within the tundish flows into the casting mold to replace the withdrawn casting.

In most horizontal continuous casting systems, the motion profile used by the puller systems to extract the casting forming with the mold is a series of forward or outward motions interleaved with brief and relatively small reverse motion steps. The latter are generally provided to ensure proper formation of the continuous casting. In many horizontal continuous systems, a slide gate is interposed between the tundish outlet and the casting mold to provide a shut-off valve mechanism. The most common slide gate includes a pair of ceramic plate members which may be interchanged. One ceramic plate defines an aperture therethrough while the other is completely closed defining no aperture. Closure of the slide gate is provided by inserting the plate having no aperture while opening of the slide gate is provided by inserting the plate having an aperture therein.

In endeavoring to improve the horizontal continuous casting process, practitioners have provided a number of variations. For example, U.S. Pat. No. 4,437,509 issued to Ahrens, et al. sets forth a METHOD FOR CONTROL OF BILLET STRIPPING in which the withdrawal of a casting from a cooled horizontal continuous mold involves withdrawing the casting in a series of steps between which the casting is pushed back by a partial step. The backward partial step ensures the welding together of casting sections. A melt breakthrough of the casting skin is prevented by measuring the expansion or contraction of a wall of the mold in contact with the casting and controlling the rate of withdrawal of the casting in response thereto.

U.S. Pat. No. 4,799,533 issued to Ahrens, et al. sets forth an HORIZONTAL CONTINUOUS CASTING MOLD which comprises a mold tube and a pair of flanges. One flange is peripherally disposed of and in abutting, liquid sealing relation with each end of the tube. The sealing relation is preferably provided by a continuous knife-edged protrusion formed in and disposed peripherally of each flange. The knife-edge is adapted to sealingly cooperate with a continuous shallow groove formed in and disposed peripherally of each end of the tube. Cooling means including a liquid jacket and baffle surround the mold tube.

U.S. Pat. No. 4,789,021 issued to Ahrens sets forth a SHORT MOLD FOR CONTINUOUS CASTING having a short taperless casting die coupled to a plurality of cooling plates having means for circulation of coolant therethrough. The cooling plates are arranged in a serially overlapping configuration in which the plates are individually movable to accommodate variations of the casting. Hydraulic means are operative upon the cooling plates to assert a contact force and maintain the cooling plates in contact with the casting surfaces.

U.S. Pat. No. 4,774,996 issued to Ahrens, et al. sets forth a MOVING PLATE CONTINUOUS CASTING AFTER-COOLER having a plurality of cooling plates each of which includes means for circulation of a coolant therethrough. The cooling plates are arranged in a serially overlapping configuration in which the plates are movable to accommodate variations of the casting. Hydraulic means are operative the cooling plates to assert a contact force holding the cooling plates in contact with the surfaces of the casting.

U.S. Pat. No. 5,215,142 issued to Ahrens sets forth a MULTIPLE MOLD WITH CHANGE-OVER FEATURE FOR HORIZONTAL CONTINUOUS CASTING which includes a tundish having a refractory lining and supporting a quantity of molten metal therein. The tundish supports a slide gate shut-off device. A rotating drum supports a plurality of interchangeable casting molds and is operable utilizing a hydraulic motor and linear bearing support. The motor operates to rotate the drum and thereby interchange the casting molds brought into alignment with the slide gate.

Ideally, it would be desirable to operate a horizontal continuous casting system in a virtually endless extended operation in which equilibrium is reached and casting takes place continuously and in which the supply of molten metal with the tundish is periodically replaced. Unfortunately, several factors limit the extent to which a horizontal continuous casting system may be operated in an uninterrupted manner. One of the most significant limitations upon the duration of horizontal continuous casting operation is the substantial wear imposed upon the continuous casting mold. Within the mold, a ceramic element generally known as a break ring is used to interface the slide gate to the mold and is subject to substantial wear during the normal casting process. In addition, the mold itself is usually formed of a copper metal or the like which has a significant tendency to wear as the forming casting is drawn through the mold passage. Other factors such as breakdown or failure of the mold which compromise its integrity or safety also frequently force shutdown of continuous casting operations. In addition to mold problems, however, other factors within the horizontal continuous casting systems of the type to which all mechanical and electromechanical systems are subject, contribute to periodic shutdown of the casting operation.

A substantial number of problems arise when a horizontal continuous casting system is prematurely shutdown which have severe impact upon the economics of casting operation. Shutdown itself is accomplished relatively simply in systems having slide gate apparatus by the insertion of the apertureless ceramic plate which terminates the flow of molten metal into the mold. In other systems not utilizing a slide gate, a starter bar is moved through the mold to the tundish nozzle aperture. The problems associated with such shutdowns, however, are substantial. Almost immediately upon the termination of the casting process, the molten metal within the tundish begins to cool and approach its freezing temperature. This freezing problem is particularly critical in the tundish region near the slide gate and tundish nozzle. The metal freezing within the slide gate and nozzle is virtually impossible to prevent and causes a shutdown. Restarting of the casting operation is impossible and an entirely new setup is necessary.

Thus, while horizontal continuous casting operations may survive brief interruptions of the casting process, any extended duration shutdown forces a complete termination of the casting operation. Thus, once the operator has determined that the interruption of casting operation will force a complete shutdown, the tundish must be completely emptied to prevent the tundish orifice area from freezing off and exacerbating the problems of restarting. In addition, the refractory lining of the tundish must be inspected and repaired in preparation for the next casting operation. The refractory lining within the tundish tends to form small cracks due to its ceramic character during the casting process. These cracks, in turn, become filled with molten metal as the tundish supply of molten metal is maintained. Upon shutdown and cooling, the molten metal within these cracks freezes to form metal "fins" extending in the refractory lining. These metal fins must be extracted from the refractory lining and the lining cracks patched using a repair material before the tundish is again used in the continuous casting operation. In addition, in systems using a slide gate, the ceramic material of the slide gate mechanism is subject to fatigue and cracking and thus must often be replenished and replaced before casting may be resumed.

One of the most critical areas of the horizontal continuous casting apparatus which effects the cycle length between shutdowns is that which includes the tundish nozzle and its interface to the casting mold. The tundish nozzle is an insulative element having a metal flow passage therethrough which is positioned between the discharge orifice of the tundish and the casting mold. The tundish nozzle is typically formed of a material such as zirconium oxide or equivalent material selected for its strength and resistance to heat. One of the critical functions of the tundish nozzle is to provided an insulated interface between the molten metal within the tundish and the cooled surfaces at the entrance of the casting mold or die. The juxtaposition of the high temperature molten metal and the cooled surface of the mold and the mold entrance raises the potential for an undesired freezing of the molten material at the mold input orifice as it passes from the tundish interior through the nozzle passage and into the casting mold. Additionally, the material utilized in constructing tundish nozzles such as zirconium oxide comprises a ceramic material which is pressed, fired, machine ground and further machined to complete its fabrication. The choice of zirconium oxide in the fabrication of tundish nozzles results from a recognition of its relatively low heat transfer characteristic. However, it is also recognized that zirconium oxide is not the optimum material as to wear and mechanical strength. In fact, zirconium oxide often lacks the required strength to provide tundish nozzles which are durable in use and which are not subject to excessive wear. The result is a compromise balancing heat transfer and strength. In many instances, the usable life of the presently manufactured tundish nozzles is as short as three to seven hours with exceptional instances extending for several days of use at the most. Such limitation of the usable life of the presently utilized tundish nozzles imposes a substantial limitation upon the continuous operational capabilities of the present day horizontal continuous casting apparatus.

There remains, therefore, a long felt and unresolved need in the art for evermore improved tundish nozzle structures.

SUMMARY OF THE INVENTION

Accordingly, it is a general object of the present invention to provide an improved tundish nozzle structure. It is a more particular object of the present invention to provide an improved tundish nozzle structure which reduces the heat transferred between the tundish metal and the cooled casting mold of a horizontal continuous casting system. It is a still more particular object of the present invention to provide an improved tundish nozzle for horizontal continuous casting systems which avoids excessive wear and extends the operative interval between shutdowns.

In accordance with the present invention, there is provided for use in a horizontal continuous caster, a tundish nozzle comprising a nozzle body defining a melt passage therethrough and a face; a face surface contour formed on the face defining a contour that provides contacting face portions and non-contacting face portions; and attachment means for securing the nozzle to a casting mold, the face surface contour cooperating with a mold face of a casting mold when secured thereto whereby the area of contact between the tundish nozzle and the casting mold is located at the periphery of the tundish nozzle thereby reducing the heat transfer between the tundish nozzle and an attached casting mold occurring near the casting mold input orifice.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 1 sets forth a typical horizontal continuous casting apparatus constructed in accordance with the present invention;

FIG. 2 sets forth a side view of a tundish nozzle constructed in accordance with the present invention;

FIG. 3 sets forth a front view of a tundish nozzle constructed in accordance with the present invention;

DESCRIPTION OF THE PREFERRED EMBODIMENTS OF THE INVENTION

Figure 4:
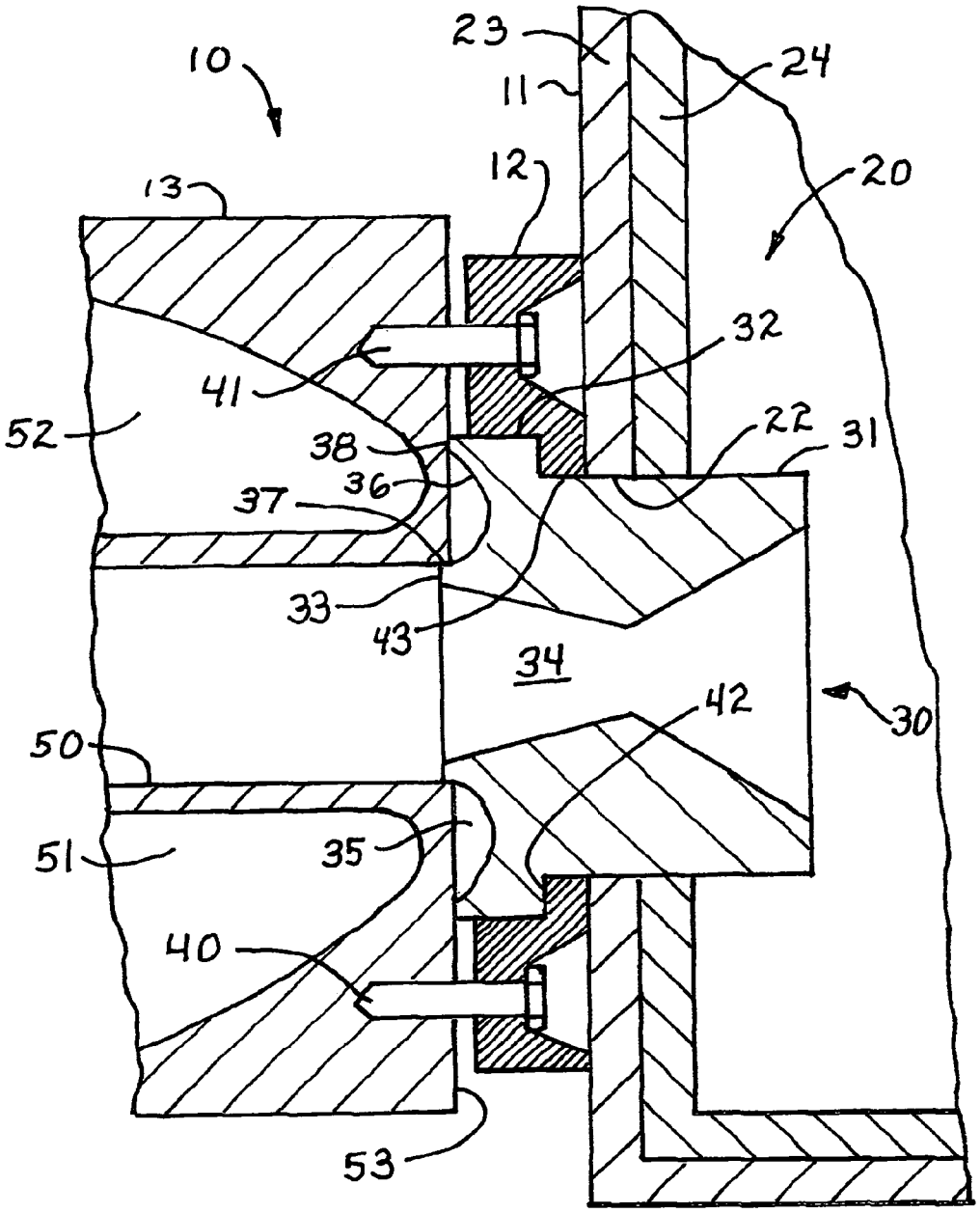
FIG. 4 sets forth a partial section view of the present invention tundish nozzle shown in FIGS. 2 and 3 together with surrounding portions of a typical tundish and casting mold.

FIG. 1 sets forth a horizontal continuous caster generally referenced by numeral 10. Horizontal continuous caster 10 includes a tundish 11 having a wall 23 and a refractory layer 24. Tundish 11 further defines an interior 20 supporting a quantity of molten metal 21 therein. As is better seen below in FIG. 4, tundish wall 23 further defines a discharge aperture 22 in the lower portion thereof. As is also better seen in FIG. 4 and in accordance with the present invention, a nozzle 30 extends through discharge aperture 22.

Returning to FIG. 1, horizontal continuous caster 10 further includes a mold 13 having an input coolant line 17 and an output coolant line 18. A nozzle plate 12 couples tundish 11 to the input of mold 13. In accordance with the present invention and as is set forth below in greater detail, this coupling includes a novel tundish nozzle. An elongated casting 16 emerges from mold 13 and in accordance with convention fabrication techniques is moved by a plurality of pullers including pullers 14 and 15. This movement of casting 16 is carried forward in accordance with a predetermined motion profile. In the anticipated use of horizontal continuous caster 10, this profile includes an outward draw followed by a brief backward movement.

In operation, the casting of molten metal 21 into casting 16 is initiated by inserting a starter bar through mold 13 into tundish 11. Thereafter, the starter bar is drawn outwardly forming a casting 16 which is pulled from mold 13. During the operation of horizontal continuous caster 10, a supply of coolant is circulated through mold 13 via input coolant line 17 through a plurality of coolant passages within mold 13 and emerges from output coolant line 16. This circulation carries away the heat transferred from casting 16 to the operative surfaces of mold 13. With the exception of the tundish nozzle supported within nozzle plate 12 and shown and described below in greater detail, horizontal continuous caster 10 may be fabricated in accordance with conventional fabrication techniques.

FIG. 2 sets forth a side elevation view of a tundish nozzle constructed in accordance with the present invention and generally referenced by numeral 30. Tundish nozzle 30 defines a generally cylindrical body 31 and an extending flange 32. Tundish nozzle 30 further includes a generally cylindrical locating ring 33 generally centered on the frontal end of tundish nozzle 30. Tundish nozzle 30 is formed of a thermally insulative material having a low thermal conductivity. In the preferred fabrication of the present invention, nozzle 30 is formed of a material such as magnesium oxide, alumina, silicon nitride, silicon carbide or zirconium oxide. These materials provide extremely low heat transfer through tundish nozzle 30. In accordance with a further aspect of the present invention described below in FIGS. 4 and 5 in greater detail, the present invention tundish nozzle is constructed to locate the heat transfer surface of the tundish nozzle which actually contacts cooled mold 13 to the outer portion of nozzle 30. In this novel fabrication and construction, the present invention tundish nozzle greatly reduces the heat transfer in the critical area surrounding the input orifice of nozzle 30 between the cooled mold surfaces and the quantity of molten metal being cast by shifting heat transfer to the outer portion of nozzle 30.

FIG. 3 sets forth a front view of tundish nozzle 30. As described above, tundish nozzle 30 includes a generally cylindrical body 31 (seen in FIG. 2) supporting a generally cylindrical flange 32. Nozzle 30 further supports a locating ring 33 which encircles a melt passage 34. Melt passage 34 extends through tundish nozzle 30. Tundish nozzle 30 further defines a front face 38 having a clearance recess 35 formed therein. Clearance recess 35 defines an outer edge 36 and an inner edge 37. The shape of clearance recess 35 is shown below in FIG. 4 in greater detail. However, suffice it to note here that clearance recess 35 extends inwardly from surface 38. Surface 38 forms the outer contact area of nozzle 30 which is brought into contact with the cooled surface of mold 13 when tundish 11 is coupled to mold 13 (seen in FIG. 1).

FIG. 4 sets forth a section view of tundish nozzle 30 together with surrounding portions of a typical tundish and casting mold. Thus, nozzle 30 is shown assembled to mold 13 by nozzle plate 12 in the manner described above in FIG. 1. In addition, FIG. 4 shows the combination of mold 13, nozzle plate 12 and tundish nozzle 30 positioned in cooperation with tundish 11 such that nozzle 30 extends through aperture 22 formed in tundish wall 23. This is, in essence, the casting position for nozzle 30. It will be apparent to those skilled in the art that the present invention tundish nozzle may be secured to mold 13 utilizing alternative apparatus without departing from the spirit and scope of the present invention. The essential function of nozzle 30 is to interface between tundish 11 and mold 13.

More specifically, tundish 11 is fabricated in accordance with conventional fabrication techniques and includes a wall 23 supporting a layer of refractory material 24. Tundish 11 defines an interior cavity 20 which receives a quantity of molten metal. Wall 23 further defines an aperture 22 which provides a discharge aperture for tundish 11.

A cooled mold 13 is fabricated in accordance with conventional fabrication techniques and defines a mold passage 50 extending through the body of mold 13. Within mold 13, a plurality of coolant passages 51 and 52 facilitate the circulation of coolant about mold passage 50 during the casting process. Mold 13 further defines a mold face 53 which defines a plurality of threaded apertures receiving fasteners such as threaded fasteners 40 and 41.

In accordance with the present invention, tundish nozzle 30 includes a generally cylindrical body 31 defining a melt passage 34 extending therethrough. Nozzle 30 further includes an outwardly extending flange 32 and a nozzle face 38. Nozzle 30 further includes a locating ring 33 surrounding melt passage 34. In accordance with an important aspect of the present invention, nozzle 30 defines a nozzle face 38 and further defines a clearance recess 35 which extends from outer edge 36 to inner edge 37. Clearance recess 35 encircles locating ring 33. Locating ring 33 is received within mold passage 50 in a sufficiently precise fit to prevent molten metal from passing between locating ring 33 and mold passage 50. In this manner, molten metal passing through nozzle 30 into mold passage 50 is confined to mold passage 50 and does not move into clearance recess 35. Nozzle face 38 provides the contact surface between nozzle 30 and mold face 53 of mold 13 and provides for heat transfer in the outer portion of nozzle 30 minimizing heat transfer in the region surrounding locating ring 33.

Nozzle plate 12 defines an aperture 43 and an encircling recess 42. Aperture 43 and recess 42 facilitate the mounting of nozzle plate 12 upon nozzle 30 in the position shown in FIG. 4. A plurality of threaded fasteners such as fasteners 40 and 41 extend through recessed apertures formed in nozzle plate 12 and are received within threaded bores formed in mold 13. Thus, a plurality of fasteners such as fasteners 40 and 41 secure nozzle plate 12 to mold 13 and captivate nozzle 30 against mold face 53 of mold 13. As is seen in FIG. 4, cylindrical body 31 of nozzle 30 extends through aperture 22 of tundish 11 allowing melt passage 34 of nozzle 30 to provide communication between interior 20 of tundish 11 and mold passage 50 mold 13.

It will be noted that melt passage 34 defines a pair of oppositely directed tapers forming a narrowed throat at the approximate center of cylindrical body 31. It will be noted that the tapered character of melt passage 34 is exaggerated in FIG. 4 to facilitate a clear illustration of the tapered melt passage.

In operation, molten metal within cavity 20 of tundish 11 is induced to flow through melt passage 34 by the insertion of a conventional started bar (not shown). The starter bar facilitates the initiation of molten metal flow through melt passage 34 into mold passage 50. Thereafter, the cooling of mold 13 draws heat from mold passage 50 and thereby from the forming casting therein to facilitate the casting process. In accordance with an important aspect of the present invention, the presence of clearance recess 35 within face 38 of nozzle 30 locates the area of heat transfer between the cooled metal of mold 13 and nozzle 30 to the outer area of nozzle 30 which in turn minimizes freezing of the molten metal within melt passage 34 and the entrance of mold passage 50. This peripheral heat transfer avoids the difficulties associated with the tendency of the molten metal to freeze within melt passage 34 of nozzle 30. This peripheral heat transfer is a direct result of the provision of clearance recess 35 which provides a reduced surface contact between the inner portion of mold face 53 and nozzle 30 and provides an insulative air volume interposed between the interior face area of nozzle 30 and mold face 53. This outer heat transfer greatly increases the effectiveness of nozzle 30. In further accordance with an advantage of the present invention, the peripheral heat transfer provided the fabrication features of nozzle 30 allows nozzle 30 to be fabricated of ceramic materials which are superior in strength and durability while still maintaining the necessary insulative reduction of heat transfer. Accordingly, the material from which nozzle 30 is fabricated may be selected from materials which are substantially more durable than materials which are otherwise used in conventional tundish nozzles due to the need for their greater thermal insulative properties. Materials such as magnesium oxide, alumina, silicon nitride or silicon carbide exhibit substantially greater strength and durability in use. The novel peripheral heat transfer characteristics provided by the present invention construction features of nozzle 30 allow the use of such materials. As a result, the wear factor and durability of the tundish nozzle is greatly improved while its heat transfer characteristics are maintained. A greater wear factor and durability directly translates to a longer run of the casting procedure between shutdowns and thereby enhances the efficiency of the casting operation.

Figure 5:
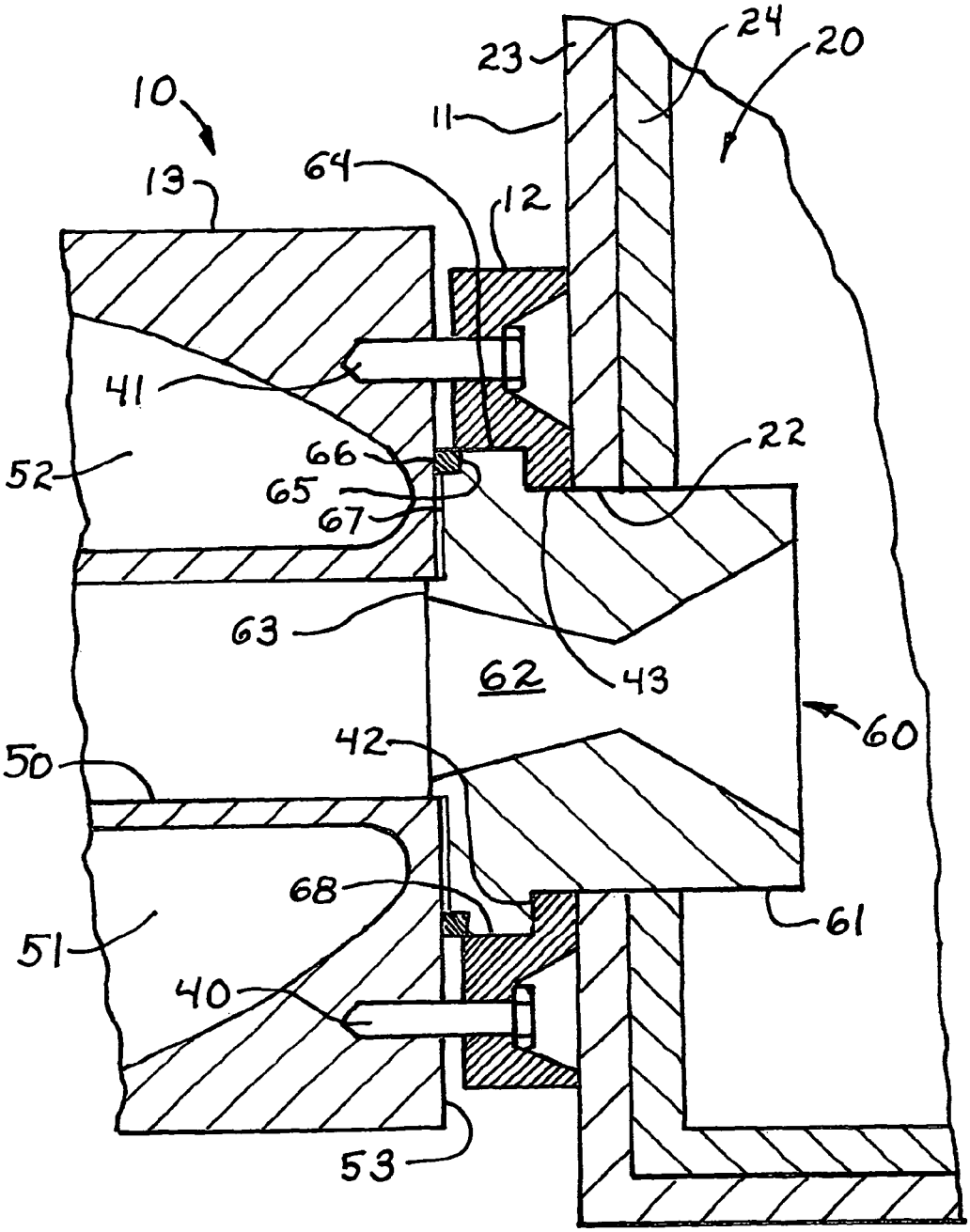
FIG. 5 sets forth a section view of an alternate embodiment of the present invention tundish nozzle together with surrounding portions of a typical tundish and casting mold.

FIG. 5 sets forth a section view of an alternate embodiment of the present invention tundish nozzle situated within the operative environment set forth above. Thus, mold 13, tundish 11 and nozzle plate 12 remain substantially the same as set forth above in FIG. 4.

More specifically, tundish 11 is fabricated in accordance with conventional fabrication techniques and includes a wall 23 supporting a layer of refractory material 24. Tundish 11 defines an interior cavity 20 which receives a quantity of molten metal. Wall 23 further defines an aperture 22 which provides a discharge aperture for tundish 11.

A cooled mold 13 is fabricated in accordance with conventional fabrication techniques and defines a mold passage 50 extending through the body of mold 13. Within mold 13, a plurality of coolant passages 51 and 52 facilitate the circulation of coolant about mold passage 50 during the casting process. Mold 13 further defines a mold face 53 which defines a plurality of threaded apertures receiving fasteners such as threaded fasteners 40 and 41.

Nozzle 60 includes a generally cylindrical body 61 defining a melt passage 62 therethrough. Nozzle 60 further defines a front face 67 having an outer groove 65 formed therein. Nozzle 60 also includes an outwardly extending flange 64 and a locating ring 63. Locating ring 63 extends forwardly from face 67 of cylindrical body 61. Nozzle 60 is assembled to mold 13 by positioning nozzle plate 12 upon cylindrical body 61. To facilitate this attachment, nozzle plate 12 defines an aperture 43 and recess 42 which cooperate to position nozzle plate 12 upon tundish nozzle 60 such that a portion of flange 64 is received within recess 42 and cylindrical body 61 passes through aperture 47. An annular spacer 66 formed of a insulative low heat transfer material such as the above-described ceramic materials is received within groove 65 formed at the outer edge of flange 64. The size of spacer 66 is selected to position nozzle 60 in a spaced relationship such that a small air gap 68 is formed between face 67 of nozzle 60 and face 53 of mold 13. Gap 68 is selected to provide reduced heat transfer between the inner portions of face 67. Different spacer sizes and resulting gaps may be provided as required. The essential function of gap 68 is to provide an insulating air space and avoid contact between the inner area of face 67 of tundish nozzle 60 and mold face 53 of mold 13. Thus, in accordance with an important aspect of the present invention, tundish nozzle 60 is supported by spacer 66 and a plurality of fasteners such as fasteners 40 and 41 in an attachment to mold 13 which locates the heat transferring contacting surface between nozzle 60 and mold 13 to the periphery of nozzle 60. This in turn greatly improves the heat transfer or insulative characteristics of nozzle 30 and minimizes the heat transfer between the molten metal within melt passage 62 and the cooled material of mold 13. As a result, tundish nozzle 60 provides a greatly improved insulative or reduced heat transfer characteristic in the area surrounding locating ring 63. This improved reduced heat transfer fabrication of tundish nozzle 60 facilitates the use of higher strength materials such as those set forth above in description of nozzle 30. Once again, the use of stronger more durable materials while maintaining the optimum heat transfer characteristics for nozzle 60 achieved by the present invention design increases the durability and wear characteristics of the tundish nozzle.

What has been shown is an improved nozzle for horizontal continuous casting apparatus which provides a peripheral heat transfer characteristic. The novel fabrication locates the contact area between the nozzle and the cooled surfaces of the casting mold at the periphery of the nozzle. In turn, this use of novel construction for attaining an improved heat transfer characteristic facilitates the utilization of higher strength materials to provide improved durability and reduced wear in operation.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in a horizontal continuous caster, a tundish nozzle comprising:

a nozzle body defining a melt passage therethrough and a nozzle face;

a nozzle face surface formed on said nozzle face defining outer contacting nozzle face portion and an inner non-contacting nozzle face portion recessed from and inside said outer contacting nozzle face portion; and attachment means for securing said nozzle to a casting mold, said nozzle face surface cooperating with a mold face of a casting mold when secured thereto whereby the mold face is contacted by said outer contacting nozzle face portion to locate heat transfer between said tundish nozzle and the attached casting mold at a periphery of said nozzle.

2. The tundish nozzle set forth in claim 1 wherein said nozzle face is generally planar and includes a centered locating ring extending beyond said nozzle face toward said mold.

3. The tundish nozzle set forth in claim 2 wherein said nozzle face surface includes a clearance recess forming said non-contacting portion extending inwardly from said nozzle face and wherein an air-filled insulative void is formed in said clearance recess and wherein said contacting nozzle face portion encircles said clearance recess.

4. The tundish nozzle set forth in claim 3 wherein said clearance recess and said contacting surface are generally annular.

5. The tundish nozzle set forth in claim 4 wherein said attachment means includes an outwardly extending flange defining an outer surface and wherein said clearance recess includes an inner edge encircling said locating ring and an outer edge proximate said outer surface of said flange.

6. The tundish nozzle set forth in claim 2 wherein said face includes a recessed groove and wherein said tundish nozzle further includes a spacer received within said recessed groove having a portion extending beyond said nozzle face, said spacer forming said contacting nozzle face portion and said non-contacting nozzle face portions extending between said groove and said locating ring.

7. The tundish nozzle set forth in claim 1 wherein said nozzle body is formed from a material selected from the group including Magnesium Oxide, Alumina, Silicon Nitride and Silicon Carbide.

8. A tundish nozzle for use in attachment to a mold having a mold passage and surrounding mold face, said tundish nozzle comprising:

a generally cylindrical nozzle body having a front surface and a melt passage passing therethrough;

a locating ring encircling said melt passage and extending from said front surface, said locating ring configured to be received within a mold passage;

an attachment flange extending from said generally cylindrical body; and a generally peripheral contacting portion of said front surface for contacting a mold face and a non-contacting portion of said front surface, said non-contacting surface cooperating with a mold face to form an air-filled insulative void and said contacting portion locating heat transfer between said tundish nozzle and a mold face to the periphery of said tundish nozzle when said tundish nozzle is attached to a mold face.

9. For use in a horizontal continuous caster, a tundish nozzle comprising:

a nozzle body defining a melt passage therethrough and a face, said face being generally planar and wherein said face surface contour;

a face surface contour formed on said face including a generally centered extending locating ring and defining a contour that provides contacting face portions and non-contacting face portions; and attachment means for securing said nozzle to a casting mold, said face surface contour including a clearance recess forming said non-contacting portion extending inwardly from said face wherein an air-filled insulative void is formed in said clearance recess and wherein said contacting face portion encircles said clearance recess, said face surface contour cooperating with a mold face of a casting mold when secured thereto whereby a mold contacting surface is formed at the periphery of said nozzle face to locate heat transfer between said tundish nozzle and an attached casting mold at the periphery of said nozzle.

10. The tundish nozzle set forth in claim 9 wherein said clearance recess and said contacting surface are generally annular.

11. The tundish nozzle set forth in claim 10 wherein said attachment means includes an outwardly extending flange defining an outer surface and wherein said clearance recess includes an inner edge encircling said locating ring and an outer edge proximate said outer surface of said flange.

* * * * *